United States Patent [19]

Barber

[11] Patent Number: 4,819,920

[45] Date of Patent: Apr. 11, 1989

[54] SPRING COIL ASSEMBLY

[75] Inventor: James R. Barber, Anderson, Ind.

[73] Assignee: Barber Manufacturing Company, Inc., Anderson, Ind.

[21] Appl. No.: 197,204

[22] Filed: May 23, 1988

[51] Int. Cl.[4] ..... F16F 3/00; A47C 23/00; A47C 23/04

[52] U.S. Cl. ..... 267/90; 5/266; 5/309; 267/88; 267/110

[58] Field of Search ..... 267/86–88, 267/90, 94, 110, 103; 297/452; 5/263, 266, 274, 309

[56] References Cited

U.S. PATENT DOCUMENTS

| | | | |
|---|---|---|---|
| 1,206,073 | 11/1916 | Young | 267/94 |
| 1,218,770 | 3/1917 | Hills | 267/87 |
| 2,234,425 | 3/1941 | Hopkes | 267/87 |
| 2,255,958 | 9/1941 | Asaro et al. | 267/87 |
| 2,272,807 | 2/1942 | Kronheim | 267/99 |
| 2,280,912 | 4/1942 | Hopkes | 5/266 |
| 2,680,475 | 6/1954 | Canton | 267/95 |
| 2,685,328 | 8/1954 | Hopkes | 267/88 |
| 2,729,830 | 1/1956 | Gleason | 5/266 |
| 2,870,823 | 1/1959 | Staples | 267/110 |
| 3,386,725 | 6/1968 | Fujikawa | 267/110 |
| 3,671,031 | 6/1972 | Krakauer | 267/110 |
| 4,348,014 | 9/1982 | Litkewycz | 267/87 |
| 4,364,547 | 12/1982 | Crosby | 267/110 |

FOREIGN PATENT DOCUMENTS

| | | | |
|---|---|---|---|
| 2255781 | 7/1975 | Italy | 297/452 |

*Primary Examiner*—Andres Kashnikow
*Assistant Examiner*—Robert J. Oberleitner
*Attorney, Agent, or Firm*—Woodard, Emhardt, Naughton Moriarty & McNett

[57] ABSTRACT

A spring cushion structure with a plurality of hour-glass shaped spring coils arranged in columns and rows with adjacent springs within a row connected at the top and bottom by a helical wire extending between adjacent columns and with the marginal coils attached at the top to a border wire extending around the assembly. A transparent sheet is placed between the bottoms of the assembly and support sinuous wires which are bent to provide an upwardly extending integral suspending arm and bent again to provide an outwardly extending shepherd hook shaped attachment arm which is attached to a wood frame surrounding the periphery of the entire structure.

11 Claims, 3 Drawing Sheets

SPRING COIL ASSEMBLY

BACKGROUND OF THE INVENTION

This invention relates to spring coil assemblies, and more particularly to a spring coil assembly with sinuous wires supplying a support base for hour-glass coils with a transparent noise reducing material disposed between the two.

There are various types of spring coil constructions used in manufacturing furniture. However, the various spring coil assemblies often result in noisy operation after several years of use. This noise is a result of the wires in the coils rubbing against the material used for support upon weight bearing and removal of weight. A typical means of reducing this noise (and one which applicant's assignee has used in products sold for more than one year) has been to dispose woven fabric between the coil springs and the support base. One disadvantage to the use of woven fabric is that it masks the internal construction of the coil assembly of the furniture in which it is used. With woven fabric disposed between the support base and the coil springs, a customer is unable to visually inspect the coil assemblies of the furniture that he or she is considering buying. Additionally, in the event that the chair becomes damaged, a repairman is unable to do an initial visual inspection to determine whether it is necessary to remove a portion of the coil spring assembly. Therefore, a repairman is required to remove the support base and the fabric disposed therebetween in order to determine whether the problem arises from damage to the coil springs.

Several patents have been discovered which disclose various coil spring assemblies. The following is a list of patents which relate in one way or another to the present invention.

| U.S. Pat. No. | Patentee | Date Issued |
|---|---|---|
| 1,206,073 | Young | 11/28/16 |
| 1,218,770 | Hills | 3/13/17 |
| 2,234,253 | Hopkes | 3/11/41 |
| 2,255,958 | Asaro et al. | 9/16/41 |
| 2,272,807 | Kronheim | 2/10/42 |
| 2,280,912 | Hopkes | 4/28/42 |
| 2,680,475 | Caton | 6/08/54 |
| 2,729,830 | Gleason | 1/10/56 |
| 4,348,014 | Litkewycz | 9/07/82 |

Young (U.S. Pat. No. 1,206,073) discloses a seat spring with a plurality of hour-glass coil springs arranged in rows and columns which are connected together at their tops by clips. The marginal springs are connected at the tops to a wire border. Sinuous springs are encased in cloth pockets and extend across the tops of the hour-glass coils. The sinuous springs do not provide a bottom support to the hour-glass coils.

Hills (U.S. Pat. No. 1,218,770) discloses a spring assembly with a plurality of coil springs arranged in a row with the tops of the springs in each row being attached to a sinuous support spring. Rather than attaching the springs in a row together with a helical wire and then attaching the row to the sinuous wire in only three places, as is done with the present invention, Hills attaches each spring to the sinuous wire with four clips. Additionally, Hills does not describe a transparent sheet of material juxtaposed between the coil springs and the sinuous springs, nor the attaching of the tops and bottoms of the springs in a row with a helical wire.

Hopkes (U.S. Pat. No. 2,234,253) discloses a spring support with a plurality of sinuous springs forming a top spring surface and bottom spring surface joined by a second plurality of sinuous springs transversely oriented with regard to the top sinuous springs. Coil springs are disposed between the top surface and bottom surface and strips of webbing are placed between the coil springs and the sinuous springs to prevent squeaking caused by metal to metal rubbing. Hopkes does not disclose attaching the tops and bottoms of the hour-glass coil springs with a helical wire nor the use of a transparent material between the coil and sinuous springs.

Asaro et al., (U.S. Pat. No. 2,255,958) discloses a spring cushion structure with a base which appears to be hour-glass coil springs arranged in rows with the marginal springs attached at the top to a border wire. The weight bearing surface of the spring assembly is a plurality of sinuous springs disposed over the hour-glass coil base structure. Material is disposed between the base and the sinuous springs to provide a sound deadening means. Asaro does not disclose the attachment of the hour-glass springs with helical wires nor the use of a transparent material between the hour-glass springs and sinuous springs which support the hour-glass springs.

Kronheim (U.S. Pat. No. 2,272,807) discloses an upholstery construction with a wood frame having a plurality of hour-glass springs arranged in rows contained therein. The tops of the hour-glass springs are connected to each other and to the wood frame by tie cords instead of having the tops connected to each other by helical wire and to a wire border by clips. The bottoms of the hour-glass springs rest on a piece of burlap which is attached under tension to the wooden frame. The bottoms of the hour-glass springs are not connected by helical wires. Disposed below the burlap, but not directly under the springs, are a plurality of sinuous springs with bends on either end to allow for attachment of the sinuous springs to the top of the wood frame. Because the burlap is tensioned between the bottom of the frame, the ends of the sinuous springs must extend through the burlap. FIG. 9 discloses an embodiment where the sinuous springs are disposed directly under the hour-glass springs with material strip webbing disposed therebetween.

Hopkes (U.S. Pat. No. 2,280,912) discloses a spring structure with spiral coil springs arranged in rows and columns. The coil springs are connected at the bottom to structural cross members. The marginal coils are joined at the top to a border wire. Sinuous springs extend above the top of the coil springs to form a support surface. No material is disposed between the coil and sinuous springs to reduce noise. Also, the sinuous springs don't form a bottom support for the coil springs.

Caton (U.S. Pat. No. 2,680,475) discloses a spring seat construction with a plurality of fabric encased coil springs arranged in rows and columns atop a plurality of braces. The tops of the fabric encased coil springs are connected to each other by criss-crossed helical wire connections and the marginal coil springs are attached to an upper border frame. Extending across the coil springs in a plurality of sinuous springs. The sinuous springs don't provide bottom supports to the coil springs.

Gleason (U.S. Pat. No. 2,729,830) discloses a spring assembly unit with a plurality of coil springs arranged in rows with the tops of adjacent rows of springs connected by helical wires and the marginal coil springs attached to a border wire. The base of the springs are connected to sinuous support springs. Gleason neither teaches nor suggests that transparent material may be juxtaposed between the bottoms of the coil springs and the sinuous support springs to reduce noise caused by friction between these elements, while still allowing visual inspection of the spring assembly. Gleason also does not disclose the hour-glass springs which are connected at the top and bottom by helical wire but instead connects each coil spring to the sinuous support springs.

Litkewycz (U.S. Pat. No. 4,348,014) discloses a torsion bar spring auxiliary panel for a bedding unit. The auxiliary panel has a wire border with sinuous springs extending therebetween. The auxiliary panel lies on a base with hour-glass coil springs arranged in rows and columns within a border wire. The coil springs are hooked together in some manner with helical connector springs. No mention appears to be made of disposing a transparent material between the sinuous springs and coil springs to reduce noise.

SUMMARY OF THE INVENTION

One embodiment of the present invention is a spring cushion assembly for a piece of furniture which has a frame with an internal surface sized to define the intended weight bearing surface of the piece of furniture. Within the frame is located a plurality of hour-glass coil springs arranged in rows and columns with the adjacent springs in each row being connected together by helical wires that extend between adjacent columns. The helical wires attach the hour-glass coil springs both at the top and the bottom. The marginal coils in the hour-glass coil assembly are connected to a border wire which extends around the top of the assembly. A piece of transparent material is positioned between the bottoms of the hour-glass coils of the assembly and a plurality of sinuous support wires which extend beneath each row of coil springs. The sinuous support wire has an integral upwardly extending suspending arm with an outwardly extending shepherd's hook shaped attachment arm on each end and the shepherd's hook shaped attachment arm is attached to the frame.

One object of the present invention is to provide a spring cushion assembly which reduces noise caused by rubbing of metal components of the assembly with a metal support base.

Another object of the present invention is to provide noise reduction in a cushion assembly while allowing for visual inspection of the assembly by a customer or repairman.

Other objects and advantages of the present invention will be apparent from the following description.

DESCRIPTION OF THE PREFERRED EMBODIMENT

Figure 1:
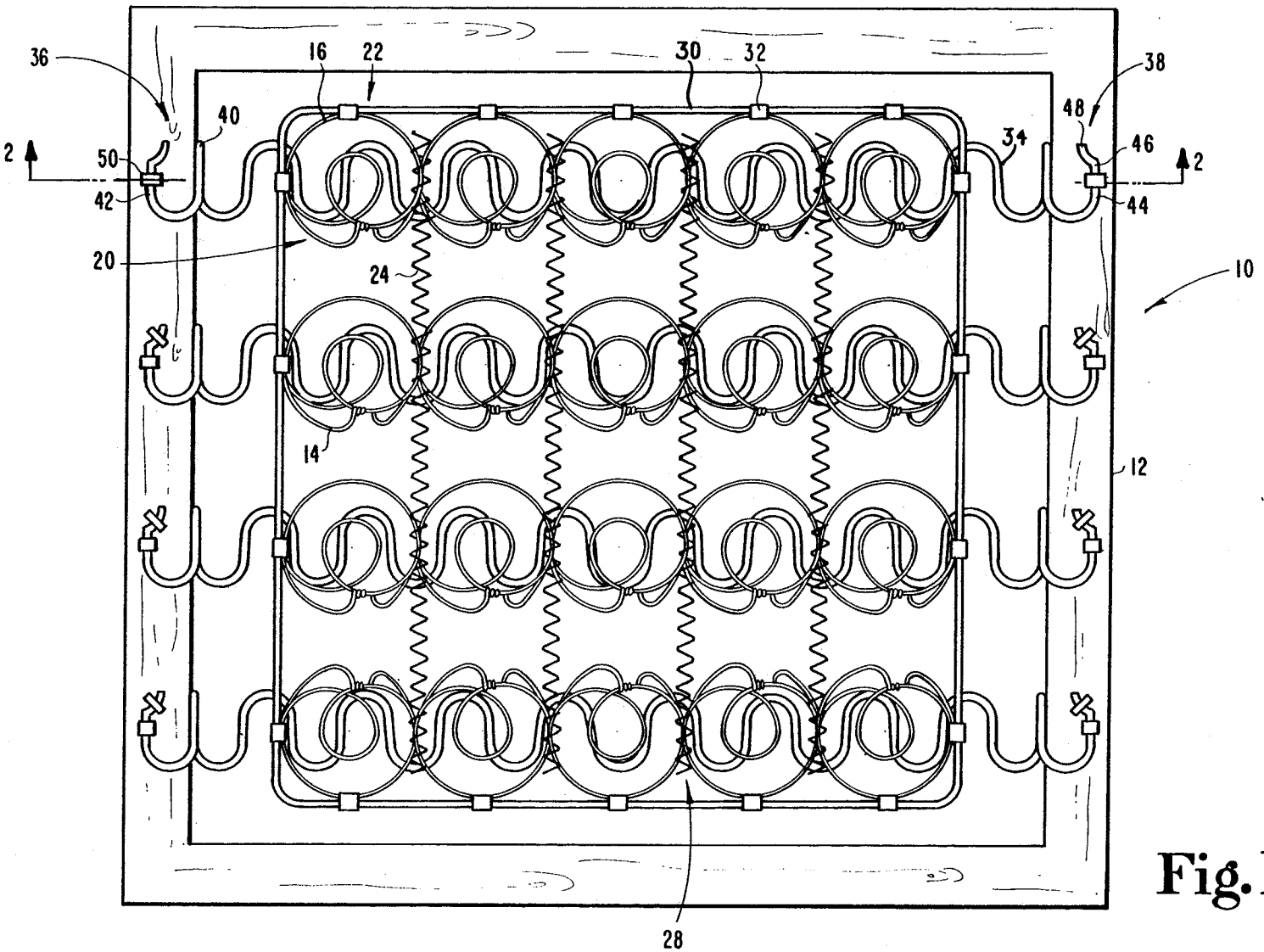
FIG. 1 is a top view of the cushion assembly according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated the spring cushion structure 10 with a rectangular wood frame 12, with a plurality of hour-glass shaped coil springs 14 disposed therein. Hour glass springs 14 are arranged in rows 20 and columns 22 as shown, the number of springs in a row 20 and the number of columns 22 being determined by the size of the unit desired. Each hour-glass spring 14 in a row contacts or overlaps with the adjacent hour-glass spring 14, both at the top convolution 16 and bottom convolution 18 (see FIG. 2). Each spring in a row 20 is connected both at the top convolution 16 to the top convolution 16 of the adjacent hour-glass spring 14 by a helical wire 24, which extends completely across the spring assembly between adjacent columns 22. Helical wire 24 wraps around the top convolution 16 of the adjacent hour-glass coil springs 14. Each hour-glass shaped coil spring 14 is also connected at the bottom convolution 18 to the hour-glass shaped coil spring 14 which is adjacent to it in the row 20 by helical wires 26 which extend completely across the coil spring assembly 28 between columns 22. A thick rectangular border wire 30 with rounded corners extends around the spring assembly 28 and is connected to the top convolution 16 of the marginal hour-glass shaped coil springs 14 by a clip 32 or a hog ring.

To provide support for the base of the coils of the assembly 28, there is provided a conventional type of resilient wire known as sinuous wire 34, formed of generally U-shaped portions having straight legged sections, which U-shaped portions are serially, alternately positioned. Sinuous wire 34 is of a gauge and resiliency to hold the hour-glass coil rings 14 in their normal expanded position and to provide flexibility when subjected to weight and use. Although sinuous wire 34 is conventionally available, the sinuous wire 34 used in this invention is unique in the manner in which the ends of the sinuous wire are fashioned. At each end 36 and 38, the last two U-shaped sections of sinuous wire 34 are bent in a unique manner to provide an upwardly extending integral suspending arm 40 and an attachment arm 42. The upwardly extending integral suspending arm is shown to extend at a 90° angle from the support portion of the sinuous support wire but that angle could be as much as 120°.

The last straight legged section on each sinuous wire is a part of the attachment arm 42 and rather than being a straight legged section, has a first straight portion 44, an angled section 46 which angles off of the straight legged section 44 at approximately a 45° angle, and a second straight legged section 48 which angles at another 45° angle from the angled section 46 so as to be parallel with the first straight legged section 44. Thus, the attachment arm has a general external shape of shepherd's hook.

Integral suspending arm 40 is in essence, one of the U-shaped portions of the sinuous wire which, rather than continuing the U-shape in the same plane as the U-shape of the remainder of the sinuous wire, instead has a U-shaped bend that is substantially transverse to the plane of the remainder of the wire. After the transverse U-shape, there is a straight legged portion and a second transverse U-shaped bend to form attachment arm which extends outwardly from the suspending arm in a plane parallel to the remainder of sinuous wire 34. The sinuous wire is attached by a staple or other appropriate means 50 across the first straight legged section 44 of the attachment arm 42 to the wood frame 12. Thus, the sinuous wire 34 forms a sort of base or bottom to the wood frame 12 in which the bottom of the assembly 28 is seated.

A sinuous wire 34 is provided for each of the rows 20 and each sinuous wire 34 is arranged on the frame so that the rows of hour-glass coils will sit directly above the sinuous wire 34. Prior to attachment of the assembly 28 to the sinuous wires 34, a transparent sheet of material 52 sized to cover the bottoms of all the coils 14 in the assembly 28 with a surface area slightly larger than the surface area of the assembly of hour-glass coil springs, is placed between the sinuous wires 34 and the assembly 28. This transparent sheet of material 52 reduces the noise which would be caused by metal-to-metal rubbing between the coil springs 14 and the sinuous wire 34 upon weight bearing or release. Additionally, the transparent sheet of material 52 allows the spring assembly to be visually inspected by both the customer or a repairman. It has been found that a six millimeter thick polypropylene or vinyl material serves well for the transparent sheet of material 52.

Figure 2:
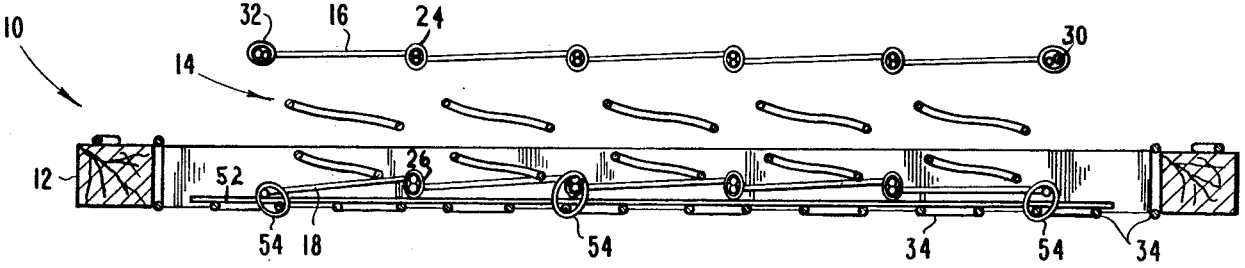
FIG. 2 is a cross-sectional view along the lines 2—2 of FIG. 1.
Figure 3:
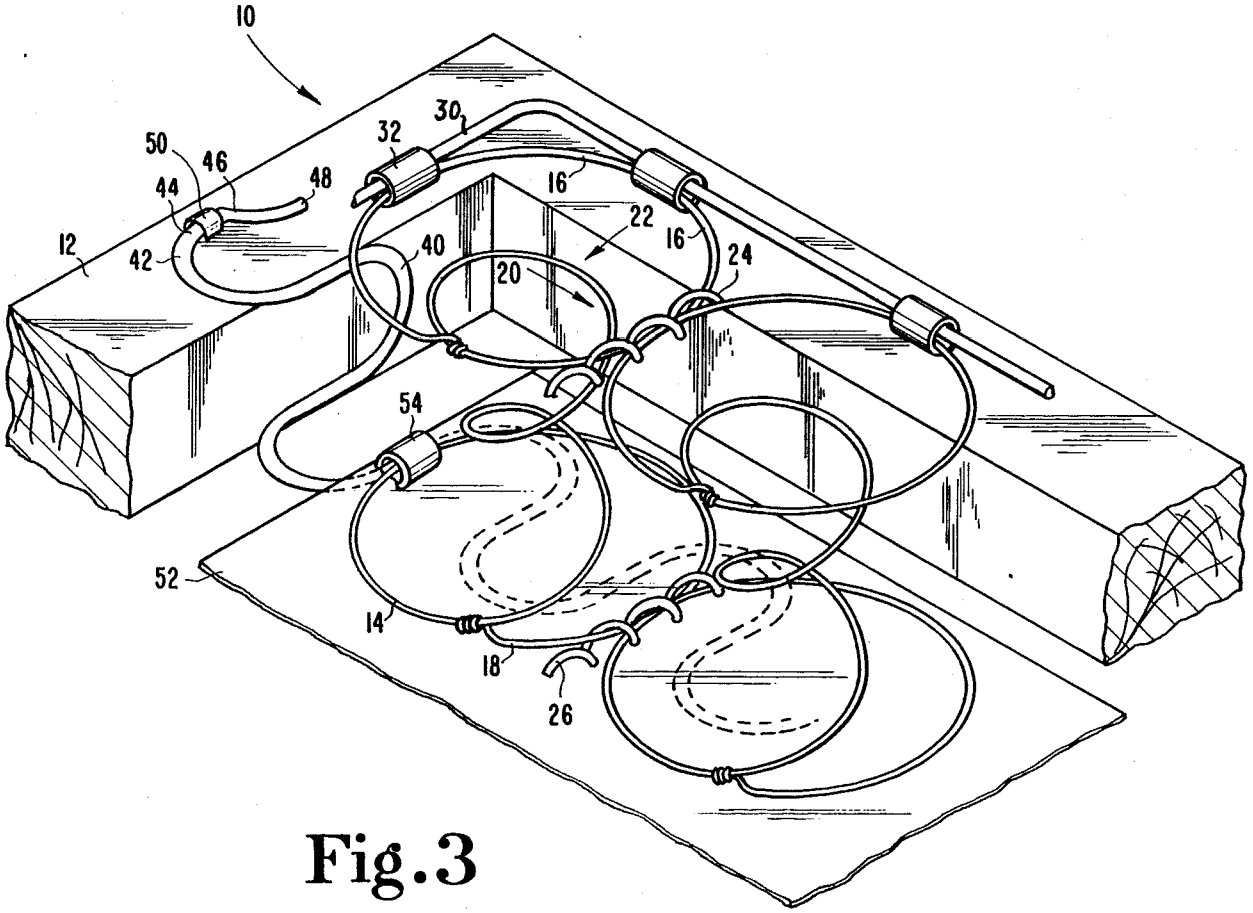
FIG. 3 is a perspective view of a corner of the assembly of FIG. 1.

Assembly 28 is attached to the sinuous wire 34 by clips or hog rings 54 which extend around a straight leg of the sinuous wire 34 through the transparent sheet of material 52 and around the bottom convolution 18 of at least one of the coil springs. Since the rows and columns of hour-glass coils 14 are already attached along the top and bottom by sinuous wires 24 and 26, there is sufficient structural integrity to the assembly 28 to allow the assembly 28 to be attached in only three places to sinuous wire 34 as is illustrated in FIG. 2. Each row 20 is attached to each sinuous wire 34 at the bottom convolution 18 of marginal hour-glass coils 14, and also at some convenient point in the middle of the row where one of the straight legs of the sinuous wire underlies the overlapping bottom convolutions 18 of the hour-glass coils 14.

As is illustrated in FIGS. 1 and 2, the outside dimensions of the spring assembly and of the border wires slightly less than the internal dimensions of the frame 12.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A spring cushion assembly for a piece of furniture comprising:

a frame with an internal surface area sized to define the intended weight bearing area of the piece of furniture;

a plurality of hour-glass coil springs, said plurality of hour-glass coil springs being arranged in an assembly having rows and columns with the external surface area dimensions of the coil spring assembly being slightly smaller than the internal surface area of said frame;

a plurality of helical wires, each helical wire extending between adjacent columns to connect two adjacent hour-glass coils in each row, a number of said plurality of helical wires connecting top convolutions of two adjacent hour-glass coils in each row and others of said plurality of helical wires connecting bottom convolutions of two adjacent hour-glass coils in each row;

a border wire extending around a margin of said assembly, said border wire being connected to the top convolutions of the marginal hour-glass coils;

a piece of transparent material positioned below the bottom convolutions of said coil spring assembly;

a plurality of sinuous support springs positioned below said piece of transparent material, each sinuous support spring underlying a selected row of hour-glass coils and being connected to said selected row by clips extending through said piece of transparent material, said plurality of sinuous springs each having an integral upwardly extending suspending arm with an outwardly extending shepherd's hook shaped attachment arm extending therefrom on each end, said shepherd's hook shaped attachment arm being attached to said frame by attaching means.

2. The spring cushion assembly of claim 1 wherein each sinuous wire is connected to the row of coil wire which it underlies in not more than three places.

3. The spring cushion assembly of claim 1 wherein said transparent piece of material is made of polypropylene.

4. The spring cushion assembly of claim 1 wherein said piece of transparent material has a surface area slightly larger than the surface area of the assembly of hour-glass coil springs.

5. The spring cushion assembly of claim 1 wherein each of said upwardly extending suspending arms forms an angle of between 90 degrees and 120 degrees with a support portion of the sinuous support spring.

6. The spring cushion assembly of claim 1 wherein each of said plurality of sinuous support springs has a support portion and a connection portion which are formed from a plurality of straight legged portions connected by a plurality of U-shaped portions, said support portion being defined by the U-shaped portions and straight legged portions lying in a first plane and wherein said connection portion is defined by those straight legged portions and U-shaped portions which do not lie in said first plane.

7. The spring cushion assembly of claim 6 wherein said upwardly extending arm is defined by a U-shaped portion extending from an end straight legged portion of said support portion and said outwardly extending shepherds hook shaped attachment arm is attached to said upwardly extending suspension arm and said attachment arm lies in a second plane which is parallel to said first plane.

8. The spring cushion assembly of claim 7 wherein each sinuous wire is connected to the row of coil springs which it underlies in three places.

9. The spring cushion assembly of claim 7 wherein said transparent piece of material is made of polypropylene.

10. The spring cushion assembly of claim 7 wherein said piece of transparent material has a surface area slightly larger than the surface area of the assembly of hour-glass coil springs.

11. The spring cushion assembly of claim 1 wherein each of said upwardly extending suspending arms forms an angle of between 90 degrees and 120 degrees with the support portion.

* * * * *

UNITED STATES PATENT AND TRADEMARK OFFICE

CERTIFICATE OF CORRECTION

PATENT NO. : 4,819,920

DATED : April 11, 1989

INVENTOR(S) : James R. Barber

It is certified that error appears in the above-identified patent and that said Letters Patent is hereby corrected as shown below:

Column 6, claim 2, line 2, "wire" (first occurrence) should read --spring--;
"wire" (second occurrence ) should read --springs--.

Signed and Sealed this

Sixth Day of March, 1990

*Attest:*

JEFFREY M. SAMUELS

*Attesting Officer*

*Acting Commissioner of Patents and Trademarks*